US005575014A

United States Patent [19]

Kane et al.

[11] Patent Number: 5,575,014

[45] Date of Patent: Nov. 19, 1996

[54] FASTENING DEVICE FOR PROTECTIVE VETERINARY GARMENTS

[76] Inventors: George K. Kane, 4900 Pennbrook Ave., Sioux Falls, S. Dak. 57106; Gerald C. Hodapp, R.R. 4, Box 190, Mankato, Minn. 56001

[21] Appl. No.: 419,425

[22] Filed: Apr. 10, 1995

Related U.S. Application Data

[63] Continuation-in-part of Ser. No. 252,161, May 17, 1994, abandoned.

[51] Int. Cl.[6] ..... A41D 13/08; A43B 3/16

[52] U.S. Cl. ..... 2/239; 2/16; 2/22; 2/161.6; 36/7.1 R

[58] Field of Search ..... 2/239, 22, 158, 2/159, 161.6, 161.7, 168, 162, 16, 240, 242, 59, 61; 36/7.1 R, 8.1, 7.3, 10; 602/3, 62

[56] References Cited

U.S. PATENT DOCUMENTS

| | | | |
|---|---|---|---|
| 2,176,463 | 10/1939 | Meendsen | 36/7.1 R |
| 3,374,487 | 3/1968 | Slimovitz | 2/161.6 |
| 3,735,759 | 5/1973 | MacKay | 2/239 |
| 4,036,220 | 7/1977 | Bellasalma | 2/59 |
| 4,083,124 | 4/1978 | Michalak | 36/7.1 R |
| 4,335,527 | 6/1982 | Pask | 36/7.1 R |
| 4,523,586 | 6/1985 | Couri | 602/3 |
| 4,599,812 | 7/1986 | Harmsen | 2/239 |
| 4,722,143 | 2/1988 | Everett | 2/239 |
| 4,727,864 | 3/1988 | Wiesenthal et al. | 602/3 |
| 4,845,780 | 7/1989 | Reimers et al. | 2/161.7 |
| 4,908,960 | 3/1990 | Hoyt, Jr. | 36/7.1 R |
| 5,020,159 | 6/1991 | Hellickson | 2/161.7 |
| 5,144,759 | 9/1992 | Mascotte | 36/7.1 R |
| 5,402,536 | 4/1995 | Matthews | 2/16 |

*Primary Examiner*—Amy B. Vanatta

[57] ABSTRACT

A covering device for arms and feet adapted to provide a shield between the wearer and animals—especially large farm animals. The covering is uniquely fastened onto the wearer and is readily discarded upon movement to another animal or to another animal shelter.

8 Claims, 2 Drawing Sheets

FASTENING DEVICE FOR PROTECTIVE VETERINARY GARMENTS

This application is a continuation in part of our previous application Ser. No. 08/252,161; filed May 17, 1994, now abandoned, and pertains to shields placed between large livestock animals and humans for the prevention of transmission of disease from one to the other. Such shields are regularly used by veterinarians while treating such animals and are often used by those engaged in the raising of such animals.

BACKGROUND AND SUMMARY OF THE INVENTION

There are at least two somewhat different reasons for providing a shield between a foot or an arm of the human that should be shielded from direct contact with the livestock. In one instance, boots or shoes used in walking around the livestock shelters are apt to pick-up bits of manure. If the manure contains any contagion, carrying such contagion to another shelter may infect an entirely new herd with the same infectious material. Therefore, it is highly desirable that foot coverings be isolated in the first shelter or discarded so as to prevent spread of infection to another shelter.

In a second instance, protection of an individual animal or of the person attending that animal may be desired. For example, cows giving birth to a calf frequently struggle more than is desirable in the birth process. In such instances, it may be desirable for someone—frequently a veterinarian—to physically reach up the birth canal to grasp the legs of the calf and to assist the process by pulling on the calf to assist its movement down the canal. In this process, it is desirable to maintain, so far as possible, an antiseptic barrier between the arm of the person and the interior membranes of the birth canal. Again, a disposable shield provides such a barrier.

Barriers of this type have long been used. Usually, the form is a thin, flexible and impervious material, often plastic, which is formed into a loose fitting boot or a glove having a long gauntlet. These work reasonably well, but are far too often subject to falling or sliding off the foot or arm of the wearer. Some more recent developed garments, particularly boots, use a tear strip on the open end which can be torn most of the way across the top and then used to form ribbon-like ties which are tied around the upper part of the boot on the leg of the wearer. Such ties, if fastened too tightly, or if strained by any outside forces, frequently cause a tearing of the adjacent material, and therefore a loss of desirable protection. This present invention provides a self-contained fastener to fasten the cover in place on either the arm or leg of the wearer making this fastener a relatively tighter closure to prevent external material from entering the interior of the protection device, and providing added convenience in the use of the device.

DESCRIPTION

Briefly, this invention comprises a protective shield to be used to prevent transmission of infection between livestock and humans. The shield is provided with a structure and device for sealing which closes the entrance to the shield more conveniently and tighter than previous shields.

Figure 3:
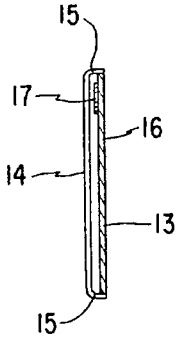
FIG. 3 is a view from line 3—3 of FIG. 2.

More specifically and referring to the figures, the invention can be embodied in either a glove 10 or a boot 20 or its alternates 20' and 20". The glove 10 is composed of a hand 11 and a long gauntlet 12 usually long enough to reach from the users hand to his armpits and shoulder to provide maximum protection. Ordinarily the glove is formed from thin sheets of plastic material cut to the proper form and then sealed securely along the edges to provide a roughly formed hand-fitting glove with a long sleeve. In this way, the gloves can be packed flat or folded and compactly packed together. Thus, as shown in FIG. 3, the glove consists of a front sheet 13 and a back sheet 14 sealed together along the edges 15.

According to the invention, the front sheet 13 is extended somewhat beyond the back sheet 14 at the open end of the glove thus making a tab 16 across the top of the garment. Near one edge of the tab 16 is a small area 17 of a sealing material. The preferred material is a pressure sensitive glue or cement which will seal securely to the material of the garment upon being pressed against it. Usually such sealing materials require a covering of releasable material which does not seal tightly and which can be removed to expose the glue for pressing against the material of the garment. Such sealing materials are well known in the art and may be used to seal evidence bags, mailing envelopes or the like.

Figure 1:
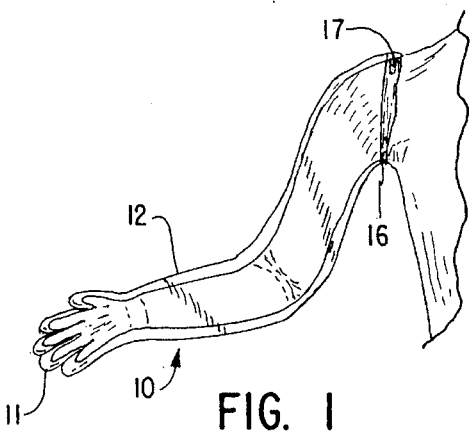
FIG. 1 is a view of a protective glove in place on the arm of the wearer.

Thus, when the glove is worn, the covering release paper can be removed from the area of sealing material. The open end of the glove extends beyond the shoulder of the wearer (FIG. 1) so that the sealing area 17 can then be pasted to the adjacent garment of the wearer.

Figure 5:
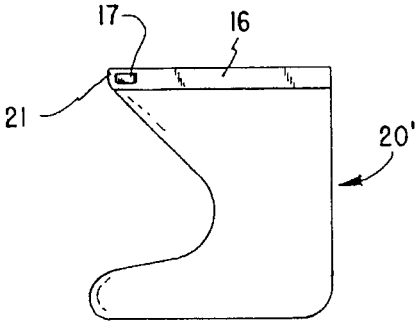
FIG. 5 is a view of a boot similar to that of FIG. 4 but of improved configuration.
Figure 4:
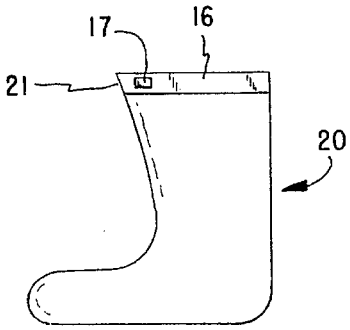
FIG. 4 is a plan view of a protective boot not in use.
Figure 6:
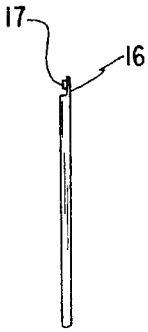
FIG. 6 is an edge view of the boot of FIG. 4 particularly showing the closing feature.

The application of the invention to a protective boot is illustrated in FIGS. 4–6. Such boots are commonly shaped as shown in FIG. 4. Generally the boot is very loose fitting and designed to be easily pulled over the ordinary work shoe or boot worn by the attendant to the livestock. In either the glove or boot embodiment there are two side walls. With the glove, the walls are referred to as "inside and outside". The boot walls are not inside and outside but simply two walls. One of the walls of the boot extends upward beyond the other to form the tab 16 on which a similar area 17 of cementing or sealing material is placed.

By wrapping the tab 16 tightly around the leg and over itself to cause the seal area 17 to fasten itself to the adjacent area of the tab 16, that tab 16 forms a tight band which excludes foreign matter such as manure from being caught within the boot to be transported by the boot. In this case, as opposed to that of the glove, the tab would normally wrap substantially around the leg. The wrapping should be such that the area 17 would be the inside surface of the material being wrapped so that merely by moving and pressing it against adjacent material, the top of the boot would be wrapped and sealed tightly.

The shape shown in FIG. 5 provides an elongated opening end 21 on which the glued area 17 is provided. This formation allows both extra convenience in pulling the boot onto the leg, but also provides a longer band formed by the tab 16, thus allowing a better and tighter wrapping around the leg to close the top.

Figure 7:
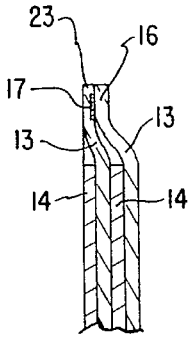
FIG. 7 is a partial sectional view from line 7—7 of FIG. 10.
Figure 8:
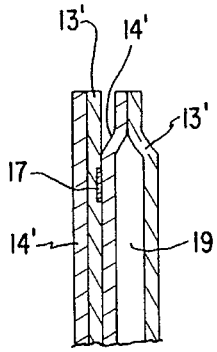
FIG. 8 is a view similar to FIG. 7 of a device not having the extension of the invention.
Figure 2:
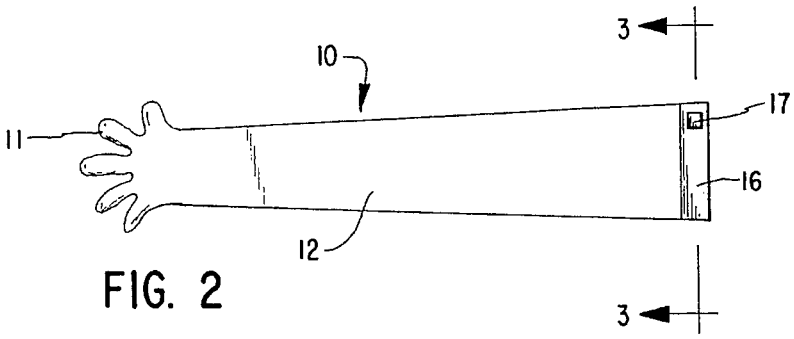
FIG. 2 is a plan view of the glove removed from the arm and showing the fastening not in use.

The real advantage of the use of the tab 16 is shown in FIGS. 7 and 8. In FIG. 7 an the extended wall 13 extends above the top of the shorter wall 14. In that way its inner surface is able to lie against the surface of the garment of the wearer of a glove. Similarly, the extension tab 16 in a boot will be able to press against the portion 23 of the inner wall that the tip 21 overlaps. The overlap therefore traps the shorter wall 14 between the layers of the extended wall. By pulling the tab snugly around the leg, it, in effect, forms a tight band which securely encloses the opening at the end of the garment against invasion by foreign materials because of the entrapment of both walls of the garment prevents the protective cover from being removed, thus improving the shield between the animal and the wearer of the protective garment.

In contrast, as shown in FIG. 8, if there is no tab 16, the area 17 of cement on the wall 14' seals against the surface of the extended wall 13', without trapping the wall 14' and leaving the outer part of the extended wall 24' free to separate and leave a gap 19 open to foreign materials. This follows because the outmost wall of the dual layer is not held to the adjacent surface of the boot except by the seams between the two walls. Unless the glue area 17 is directly at the seam, there will be spreading. If the area 17 is at the seams, great care must be taken to pull the wrap-around material tight, and even then there is a likelihood of opening a gap. By using a tab 16, the outer extended tab simply pulls the inner wall against the surface of the top of the boot and encloses it.

Figure 9:
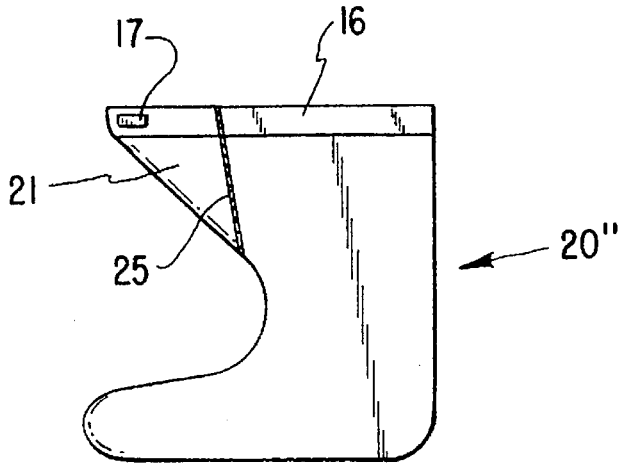
FIG. 9 is a view similar to FIG. 5 of a boot having an alternatively formed tab.

A second alternative is shown in FIG. 9. This is almost the same as the boot shown in FIG. 5 except that a seam 25 is placed across the elongated opening end 21 to seal together the two surfaces. The object is to leave an adequate opening of the boot for insertion of a foot but also to hold surfaces of the end together to provide a tab device held together so that the surfaces do not slide over each other. The result is that the wrapping of the tab around the leg is much easier than with the other embodiments.

Figure 10:
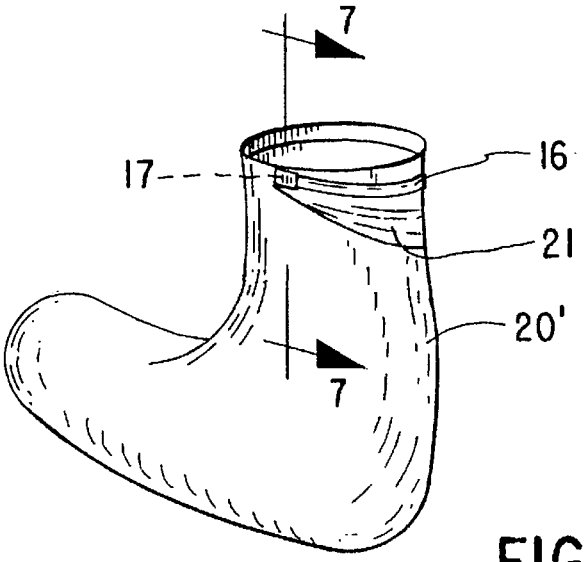
FIG. 10 is a perspective view of a boot as shown in FIG. 9 with the tab wrapped around for closure.

As shown in FIG. 10, the tab 16 can be wrapped relatively tightly about the ankle of a user. The area 17 can be exposed and attached to the adjacent portion of the boot. During this process, the seam 25 (not shown in FIG. 10 as behind the sight) prevents gapping of the two layers of the boot material, thus making the wrapping action considerably simpler.

Although sealing material has been described variously as being a glue or cement, it will be apparent that a pressure-sensitive hooked fabric such as that sold under the trademark "VELCRO" could also be used to seal the band at the top of the shield device. This kind of device would currently be considerably more expensive than necessary, but is illustrative of other possible embodiments.

Thus, the invention provides a shield covering for an outer member of the body of the wearer which can be relatively tightly closed against the introduction of foreign matter into the shield device. Fully as important as the closure is simply the retention of covering in place on the user to protect both the animal and the user from contamination.

We claim as my invention:

1. For use on an outer member comprising an arm or leg of a wearer, a shield device comprising a pair of walls cut to approximately conform to the shape of said member, said walls being sealed together along said cut walls to form closed side walls and one closed end but having a single open end at one end of said shield for entry of said member, a first wall of said pair of walls extending integrally beyond the second wall of said pair of walls for the entire width of said pair of walls to form a band extending beyond said open end over the width of said pair of walls, fastening means applied to said band whereby said band lies against adjustment material and is fastened upon said adjacent material to close said open end.

2. The shield device of claim 1 in which said shield device includes a glove end forming said closed end opposite to said open end, said glove end being formed to a glove-like shape, said open end being spaced from said glove end by a distance approximately equal to the length of an adult arm.

3. The shield device of claim 2 in which said adjacent material is the material of a garment of the wearer.

4. The shield device of claim 1 in which said shield device includes a foot end forming said closed end opposite said open end, said foot end and said open end combining with an ankle-enclosing midsection to form a boot.

5. The shield device of claim 5 in which said open end expands from said midsection to form an extended open end, said fastening means being placed near one edge of said extended open end.

6. The shield device of claim 5 in which a seam extends across said extended open end, said seam being effective to seal said walls together in the area covered by said seam.

7. The shield device of claim 1 in which said fastening means comprises an area of a pressure sensitive material whereby said open end is fastened by pressing said pressure sensitive material against the material of said band.

8. The shield device of claim 7 in which said pressure sensitive material is a cementing material adapted to cement one end of said band to an adjacent portion of the band.

* * * * *